US008944120B2

(12) United States Patent
Neuhäuser et al.

(10) Patent No.: US 8,944,120 B2
(45) **Date of Patent: *Feb. 3, 2015**

(54) METHOD AND DEVICE FOR FILLING CONTAINERS WITH A FILLING MATERIAL COMPOSED OF AT LEAST ONE FIRST AND ONE SECOND LIQUID COMPONENT AT A PREDETERMINED RATIO

(75) Inventors: Andre Neuhäuser, Sörgenloch (DE); Norman Gras, Horrweiler (DE)

(73) Assignee: KHS GmbH, Dortmund (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/395,164

(22) PCT Filed: Sep. 7, 2010

(86) PCT No.: PCT/EP2010/005476

§ 371 (c)(1), (2), (4) Date: Mar. 9, 2012

(87) PCT Pub. No.: WO2011/044972

PCT Pub. Date: Apr. 21, 2011

(65) Prior Publication Data

US 2012/0180902 A1 Jul. 19, 2012

(30) Foreign Application Priority Data

Oct. 15, 2009 (DE) ..... 10 2009 049 583

(51) Int. Cl.

| | |
|---|---|
| ***B65B 1/04*** | (2006.01) |
| ***B67C 3/02*** | (2006.01) |
| ***B67C 3/20*** | (2006.01) |

(52) U.S. Cl.

CPC .. *B67C 3/02* (2013.01); *B67C 3/208* (2013.01)
USPC ..... 141/9; 141/105; 141/248; 222/71

(58) Field of Classification Search

USPC ..... 141/9, 100, 103, 105, 234, 248; 222/71
See application file for complete search history.

(56) References Cited

U.S. PATENT DOCUMENTS 6,463,807 B1 * 10/2002 Feller ..... 73/861.12
8,631,839 B2 * 1/2014 Meinzinger ..... 141/105

(Continued)

FOREIGN PATENT DOCUMENTS

DE 102006045987 4/2008
DE 102006045987 A1 * 4/2008
EP 0775668 B1 * 10/1996 ..... B67C 3/20

(Continued)

*Primary Examiner* — Jason K Niesz
(74) *Attorney, Agent, or Firm* — Occhiuti & Rohlicek LLP

(57) ABSTRACT

Filling a container with a filling material having a first and second liquid components in a predetermined ratio includes supplying the first component from a tank to the container through a filling material line that defines opposite first and second directions, the line being closable by a valve. A flow-rate measuring unit determines an amount of first liquid component fed through the line in the second direction. The method also includes feeding the second component into the line, the line having been at least partially filled by the first component, and detecting an amount of the second component fed therein. Detecting the amount of the second component includes using a flow-rate measuring unit to detect motion of the first component caused by feeding the second component. The method then includes displacing at least a portion of the first component from the line along the first direction.

19 Claims, 5 Drawing Sheets

(56) References Cited

U.S. PATENT DOCUMENTS

| | | | | |
|---|---|---|---|---|
| 2009/0236007 | A1* | 9/2009 | Clusserath et al. | 141/9 |
| 2010/0300580 | A1* | 12/2010 | Macquet et al. | 141/83 |
| 2011/0023994 | A1* | 2/2011 | Meinzinger | 141/1 |
| 2011/0039044 | A1* | 2/2011 | Clusserath | 428/34.1 |
| 2012/0241044 | A1* | 9/2012 | Krulitsch et al. | 141/9 |

FOREIGN PATENT DOCUMENTS

| | | | |
|---|---|---|---|
| EP | 0775668 | | 5/1997 |
| EP | 2272790 | | 1/2011 |
| EP | 2272790 | A1 * | 1/2011 |
| FR | 2925022 | A1 * | 6/2009 |
| WO | 2009/129937 | | 10/2009 |

* cited by examiner

METHOD AND DEVICE FOR FILLING CONTAINERS WITH A FILLING MATERIAL COMPOSED OF AT LEAST ONE FIRST AND ONE SECOND LIQUID COMPONENT AT A PREDETERMINED RATIO

CROSS REFERENCE TO RELATED APPLICATIONS

This application is the national stage of international application no. PCT/EP2010/005476, filed on Sep. 7, 2010, which claims priority to German application no. 10 2009 049 583.5, filed on Oct. 15, 2009. The contents of the prior applications are incorporated herein.

FIELD OF DISCLOSURE

The invention relates to a method and apparatus for filling a container with a filling material having a first and second liquid components in a predetermined ratio.

BACKGROUND

Methods and devices for filling containers with a filling material which is composed of at least two components are in principle known. Such methods and devices are used in the drinks and packaging industry in particular.

Electronic flow rate measuring units which contactlessly measure the liquid volume of at least one of the liquid components dispensed to the container, and with which a predetermined proportion or mixing ratio can be set by appropriate regulation of the dispensed quantity of the at least two liquid components, are frequently used for filling with a filling material composed of at least two liquid components. Mixed drinks composed of a number of liquid components can be manufactured with almost any desired mixing ratios in this way. A disadvantage of such methods and devices is that they are not accurate enough if at least one of the liquid components contains solid constituents or solid matter such as pulps or fibres. Such methods and devices are also not at all suitable for filling highly viscous or paste-like components.

SUMMARY

In light of this, the object of the present invention is to provide a method and a device for filling containers with a filling material composed of at least two components which allows sufficiently accurate mixing of at least two liquid components especially when one of the liquid components contains solid constituents or has a viscous or paste-like consistency.

The essential aspect of the inventive method is to be seen in that the second liquid component is fed to the filling material line which is filled at least partially with the first liquid component, and that in order to determine the amount of the second liquid component that has been fed, the motion of at least a partial amount of the first liquid component generated in the filling material line by the second liquid component fed is detected using the at least one flow rate measuring unit. As a result a particularly beneficial indirect measurement of the fed amount of a second liquid component having solid constituents or a paste-like or viscous consistency becomes possible by detecting the amount of first liquid component which the feeding of the second liquid component displaces from the material line that is closed at least at one end. Because of its purely liquid consistency this amount is easy to detect electronically by conventional flow meters, especially by so-called magnetic inductive flow meters. The measurement signal so obtained can be analysed by a suitable control unit to evaluate the current mixing ratio.

It is of particular benefit that at least before the second liquid component is fed into the at least one filling material line, the first filling valve unit is closed, with the second liquid component being fed, preferably under pressure, from a second tank through a further filling material line and a second filling valve unit of the filling material line connected to that further filling material line. Pressure is built up for this in the second tank so that when the second filling valve unit is open, the second liquid component is pressed into the filling material line.

Again beneficially, the feeding of the second liquid component at least partially displaces the first liquid component that is present in the filling material line from the latter and the displaced amount of the first liquid component is detected by the at least one flow rate measuring unit. The displaced amount of the first liquid component can be at least partially fed back to the first tank or at least partially conducted in a buffer tank and/or into a return line.

In a preferred embodiment the first liquid component contained in the filling material line is moved in a first or second direction of flow or is displaced from the filling material line in a first or second direction of flow, the first direction of flow running contrary to the second direction of flow. A mixing chamber which is in fluid connection with the filling material line is also provided between the flow rate measuring unit and the first filling valve unit.

The essential aspect of the inventive device is to be seen in that, for feeding the second liquid component, the filling material line is connected to the second tank by a second filling valve unit and a further filling material line, with the at least one flow rate measuring unit being configured to detect the motion of at least a partial amount of the first liquid component, said motion being generated in the filling material line by the fed second liquid component.

There is also the possibility for a mixing chamber that is in fluid connection with the filling material line to be provided between the flow rate measuring unit and the first filling valve unit.

A buffer tank that is in fluid connection with the filling material line can also be provided between the flow rate measuring unit and the first tank. Alternatively or in addition there is also the possibility of a return line which establishes a fluid connection between the free end of the filling material line facing towards the first filling valve unit and the first tank.

According to a further embodiment, a third filling valve unit or a non-return valve is provided downstream of the first tank.

For detecting the flow rate, the flow rate measuring unit is configured preferably in a first and second direction of flow, and again preferably as a Magnetic Inductive Flow Meter.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE FIGURES

The invention is explained in detail below through the use of an embodiment example with reference to the figures. In the figures.

DETAILED DESCRIPTION

Figure 1:
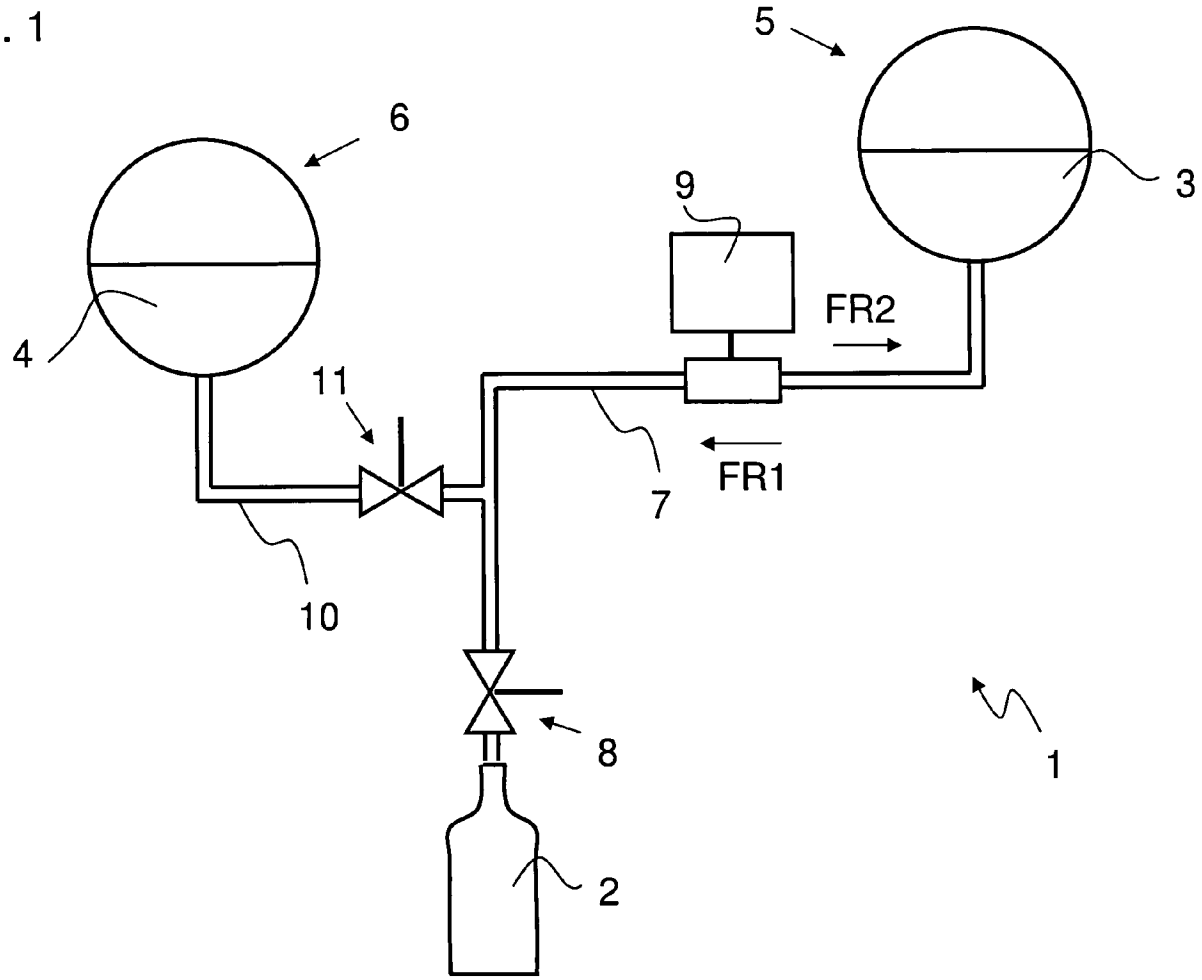
FIG. 1 shows a schematic block diagram of a first embodiment of a device for filling containers with a filling material.

FIGS. 1-5 depict by way of example different embodiments of the inventive devices 1 for filling containers 2 with a filling material that is composed of at least one first and one second liquid component 3, 4 by reference to schematic block diagrams. The device/filling device 1 can be part of for example a bottle handling plant which executes different process steps as part of the bottling of filling material.

Each of these embodiments is configured to perform the inventive method for filling containers 2 with a filling material which is composed of at least one first and second liquid component 3, 4. The inventive method is intended for use preferably in the drinks industry, specifically for filling mixed drinks composed at least of the first and second liquid component 3, 4 into containers, in particular bottles 2.

To hold the first and second liquid components 3, 4 separately, filling device 1 comprises a first and a second tank 5 and 6; in this particular embodiment the first liquid component 3 is held in the first tank 5 and the second liquid component in the second tank 6.

First component 3 is preferably purely liquid, i.e. it contains no solid constituents, whereas the second liquid component at least partially comprises solid constituents or has a paste-like or highly viscous consistency. Second liquid component 4 can therefore exhibit solid matter such as for example fruit pieces, pulps or similar items which prevent the flow rate being measured with the required accuracy using known contactless measurement techniques.

First tank 5 which holds first liquid component 3 is connected by a first filling material line 7 to a first filling valve unit 8 which is preferably arranged at the end of first filling material line 7 which is opposite first tank 5, with the remaining free end of first filling material line 7 being preferably connected to first tank 5.

Second tank 6 which holds second liquid component 4 is connected by a second filling material line 10 to a second filling valve unit 11 with which a fluid connection to the first filling material line 7 can be established. The one free end of second filling material line 10 is preferentially connected to second tank 6 and the other opposite free end to second filling valve unit 11 which in turn is connected to first filling material line 7, specifically in the region between first filling valve unit 8 and first tank 5. Second filling valve unit 11 can therefore control the feeding of second liquid component 4 contained in second tank 6 into first filling material line 7. In a preferred embodiment, gauge pressure is present in second tank 6 so that second liquid component 4 can be fed under pressure and hence without mechanical pumps which could impair or damage the contained solid constituents.

To create a mixed drink, first and second liquid component 3, 4 are fed to container 2 at a predetermined ratio M1/M2.

In the present embodiment, the mixing of first and second liquid component 3, 4 takes place preferably in first filling material line 7. For this purpose it is initially arranged for first filling material line 7 to be completely filled with liquid component 3. With first filling valve unit 8 closed, second liquid component 4 is conveyed into first filling material line 7 in a first step.

A flow rate measuring unit 9 which is interactively connected to first filling material line 7 is provided to determine the amount of second liquid component 4 which is fed to first filling material line 7. For example, the liquid volume of first liquid component 3 that is conveyed through a measuring point can be preferably contactlessly detected by means of flow rate measuring unit 9.

When the required amount of second liquid component 4 is in first filling material line 7, and with second filling valve unit 11 closed and first filling valve unit 8 open, the whole required amount of filling material is filled into container 2 during which the whole required amount of filling material is detected by flow rate measuring unit 9.

Flow rate measuring unit 9 is configured for example as a Magnetic Inductive Flow Meter, or MID for short, i.e. as a contactlessly operating magnetic inductive flow meter which in a known way generates a magnetic field in a measurement channel through which the filling material flows; said magnetic field induces an electrical voltage through the electrically conductive filling material flowing through the measurement channel, this electrical voltage being proportional to the flow rate and evaluated as a measurement signal which determines the flow rate. In a preferred embodiment, flow rate measuring unit 9 is configured to detect the flow rate in a first direction of flow FR1 and in a second direction of flow FR2 oriented contrary to first direction of flow FR1.

Alternatively, first amount M1 of first liquid component 3 that is fed to first filling material line 7 from first tank 5 is first detected by the at least one flow rate measuring unit 9 and first filling valve unit 8 is then closed, for example. In this instance, first liquid component 3 flows through flow rate measuring unit 9/first filling material line 7 in first direction of flow FR1.

Second filling valve unit 11 is then opened and second liquid component 4 is passed from second tank 6 through second filling material line 10 to first filling material line 7, whereby in a preferred embodiment second liquid component 4 is pressurised such that second liquid component 4 which is present in first filling material line 7 is pushed back but at least moved, preferably in second direction of flow FR2.

To determine the fed second amount M2 of second liquid component 4 into first filling material line 7, amount M3 of first liquid component 3 that is displaced from first filling material line 7 by fed second liquid component 4 is determined by the at least one flow rate measuring unit 9, this occurring in second direction of flow FR2 in the particular embodiment shown in FIG. 1.

Displaced amount M3 of first liquid component 3 is at least approximately the same as second amount M2 of second liquid component 4 fed into first filling material line 7. Based on knowledge of the fed first amount M1 of first liquid component 3 and the displaced amount M3 of first liquid component 3/second amount M2 of second liquid component 4 derived from this, it is possible to detect the current ratio M1/M2 and so set a predetermined ratio/mixing ratio M1/M2 by means of a suitable control unit (not shown in the figures). Depending on the flow rates determined by flow rate measuring unit 9, first and second filling valve units 8, 11 are opened and closed accordingly by means of the control unit to set a predetermined mixing ratio M1/M2.

Figure 2:
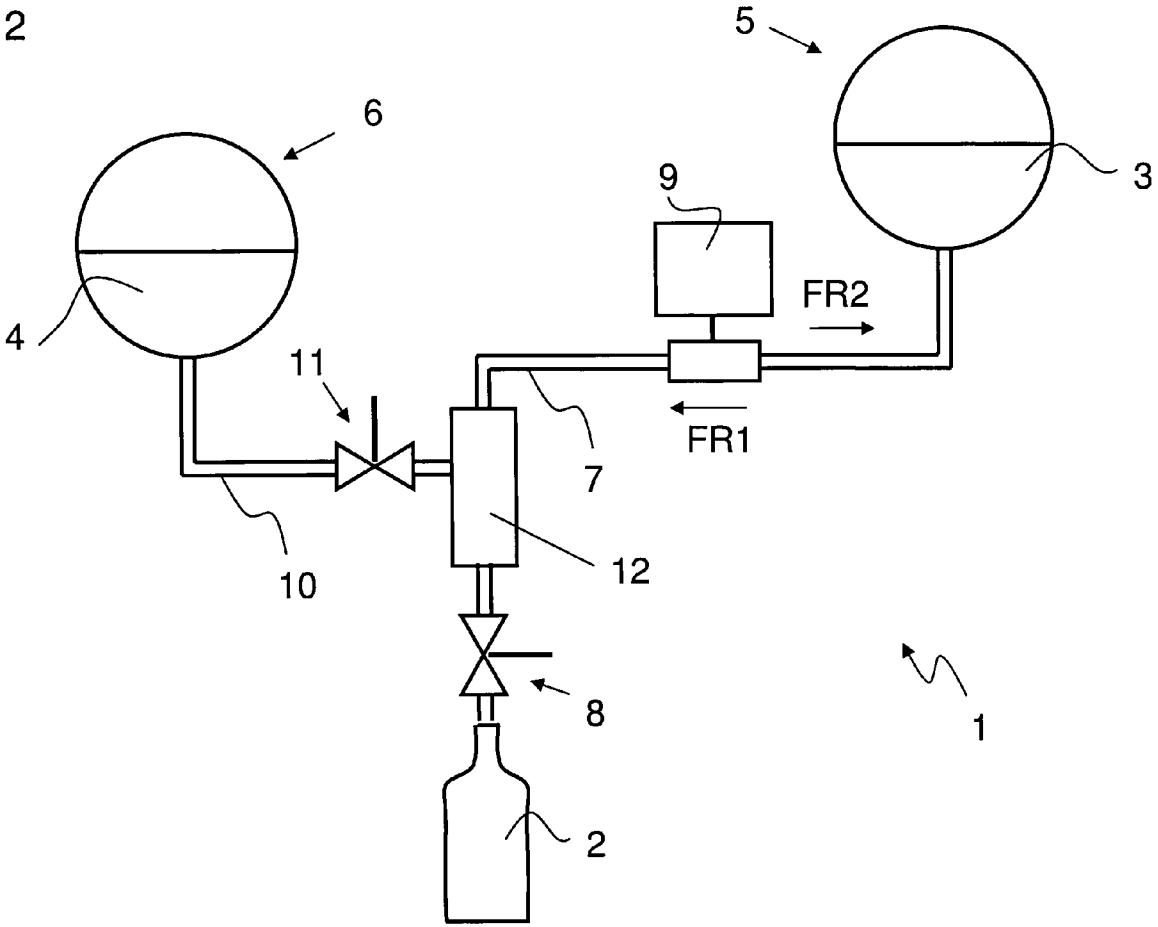
FIG. 2 shows a schematic block diagram of a second embodiment with additional mixing chamber.

In an alternative embodiment according to FIG. 2, first filling material line 7 comprises a mixing chamber 12 that is disposed between flow rate measuring unit 9 and first filling valve unit 8. Second filling valve unit 11 is preferably connected to mixing chamber 12 so that when second filling valve unit 11 is opened, second liquid component 4 is passed into mixing chamber 12 filled with first liquid component 3. The capacity of first filling material line 7 can be increased to advantage as a result of this.

Figure 3:
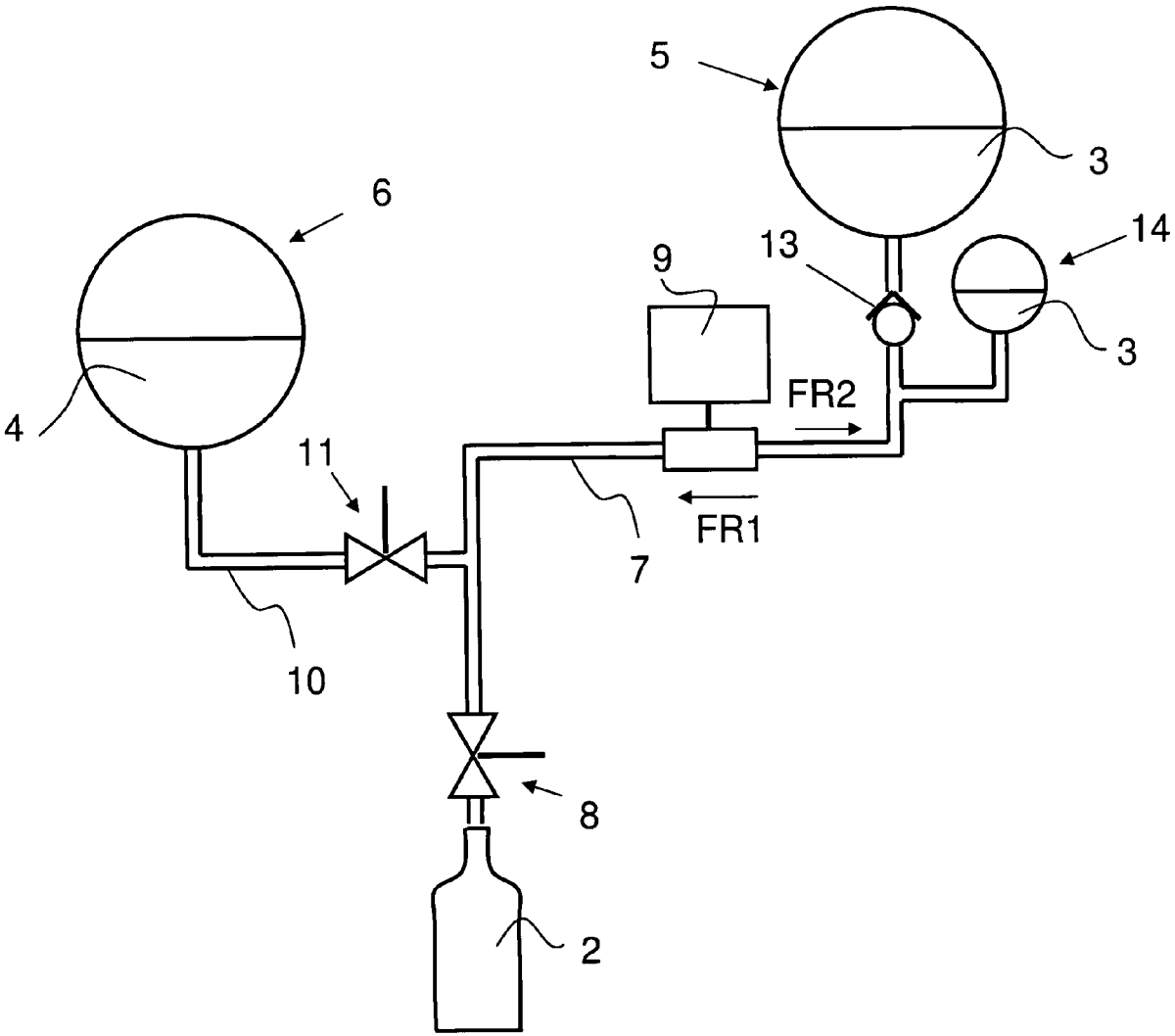
FIG. 3 shows a schematic block diagram of a third embodiment with a buffer tank.

According to the embodiment shown in FIG. 3, a buffer tank 14 which is in fluid connection with first filling material line 7 is provided between flow rate measuring unit 9 and first tank 5. A non-return valve 13 which in particular prevents a return of displaced first liquid component 3 to first tank 5 is provided preferably between the connection points of buffer tank 14 and first tank 5 to prevent a return flow to first tank 5. Displaced first liquid component 3 is instead passed to buffer tank 14 which is dimensioned accordingly. Flow rate measuring unit 9 measures flow rates M1, M3 in the first and second direction of flow FR1, FR2.

Figure 4:
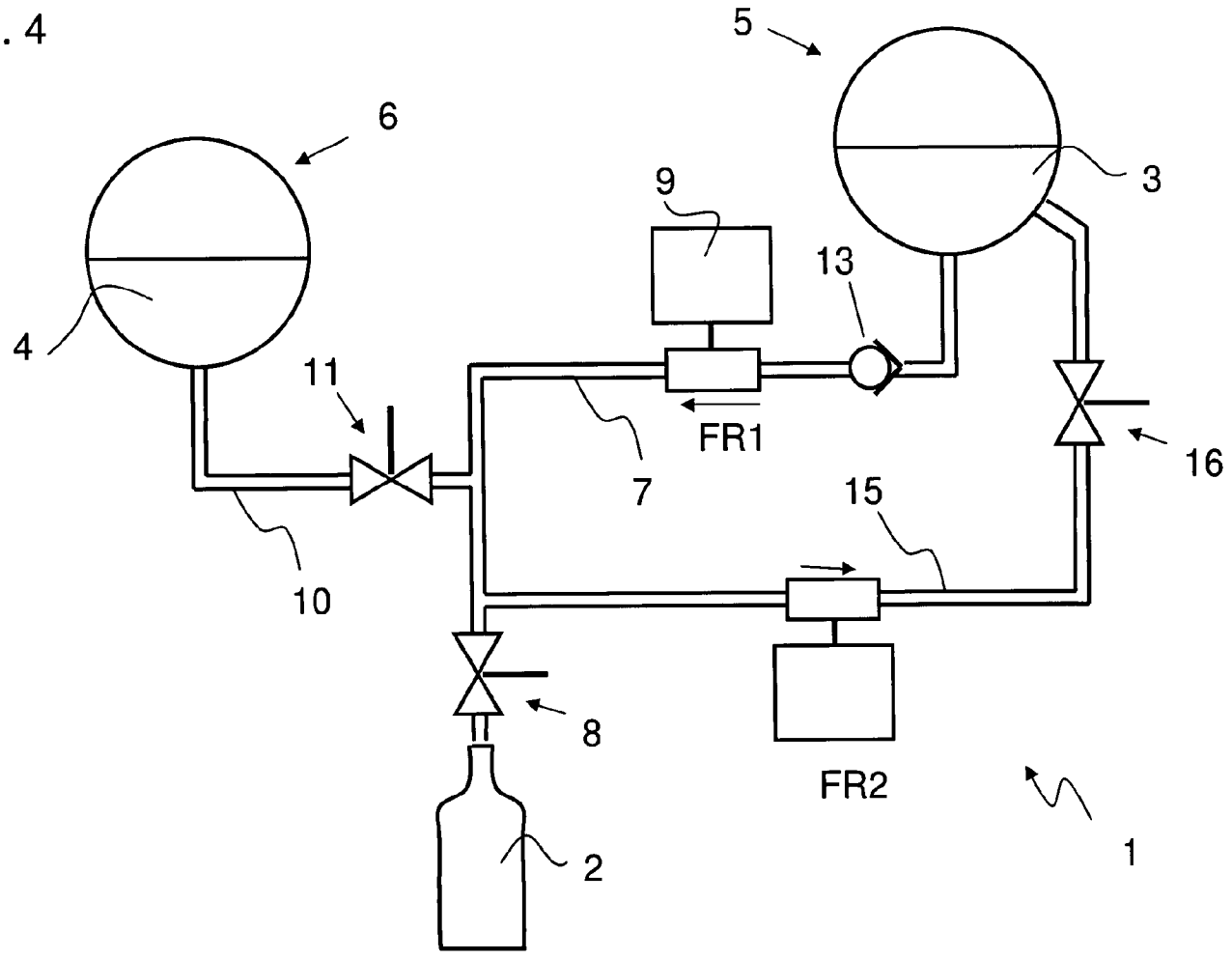
FIG. 4 shows a schematic block diagram of a fourth embodiment with non-return valve in the feed line and separate return line with filling valve unit and FIG. 5 shows a schematic block diagram of a fifth embodiment with a return line and a further filling valve unit in the feed line.
Figure 5:
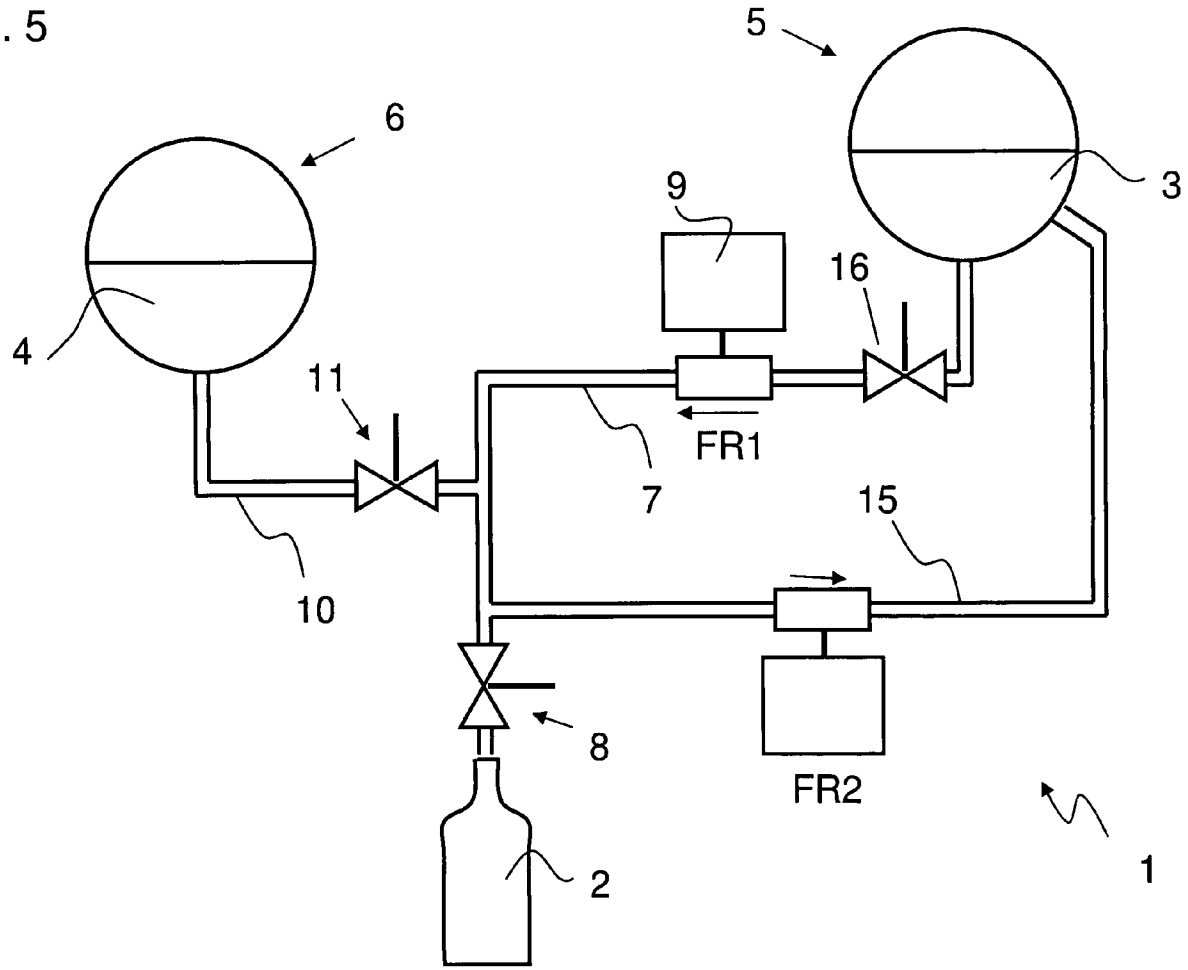

According to the embodiments shown in FIGS. 4 and 5, a flow rate measuring unit 9 is provided which is configured only to detect the flow rate in first direction of flow FR1. Here again, a non-return valve 13 which in particular prevents a return of displaced first liquid component 3 to first tank 5 through first filling material line 7 in second direction of flow FR2 is provided downstream of first tank 5. To allow a return flow of displaced first liquid component 4 to first tank 5 however, a separate return line 15 which extends from the free end of first filling material line 7 facing towards first filling valve unit 8 to first tank 5 is additionally provided. In a preferred embodiment, return line 15 can comprise a third filling valve unit 16. When feeding second liquid component 4, i.e. when first filling valve unit 8 is closed and second filling valve unit 11 is open, first liquid component 3 is displaced from first filling material line 7 into separate return line 15 and possibly to first tank 5. When feeding second liquid component 4, third filling valve unit 16—if present—is opened at approximately the same time as second filling valve unit 11, so facilitating a return through return line 15 of displaced amount M3 of first liquid component 3 to first tank 5 or possibly a provided buffer tank 14 (not shown in FIG. 4). FIG. 5 shows by way of example an embodiment in which non-return valve 13 in FIG. 4 is replaced by a third filling valve unit 16.

In the embodiments depicted in FIGS. 4 and 5, a second flow rate measuring unit is provided which is again only provided to detect the flow rate in one direction of flow, namely direction of flow FR2. This second flow rate measuring unit detects the motion of at least a partial amount of the first liquid component generated by the displacement of the first liquid component.

It is of particular advantage that the separate feeding of first and second liquid component 3, 4 on the one hand facilitates the setting of any desired mixing ratios and on the other ensures that the same mixing ratio is always present in the respective container 2. When filling material is supplied already mixed in tanks, filler tanks etc., a detrimental floating to the surface or sinking of solid constituents in second liquid component 4 that is mixed with first liquid component 3 can take place. This is not the case with the inventive method/device, and so the use of expensive agitators can be avoided to particular advantage.

The invention has been described hereinbefore by reference to one embodiment. It goes without saying that numerous variations as well as modifications are possible without departing from the inventive concept underlying the invention.

Only one flow rate measuring unit 9 has been described in each of the previous embodiments. It goes without saying that a plurality of flow rate measuring units 9 disposed separately from one another may also be provided to determine flow rates M1 to M3, disposed for example even in return line 15 and/or in the feed to buffer tank 14. They may also be configured to detect a first and/or second direction of flow FR1, FR2.

LIST OF REFERENCE CHARACTERS

1 Device or filling device
2 Container
3 First liquid component
4 Second liquid component
5 First tank
6 Second tank
7 First filling material line
8 First filling valve unit
9 Flow rate measuring unit
10 Second filling material line
11 Second filling valve unit
12 Mixing chamber
13 Non-return valve
14 Buffer tank
15 Return line
16 Third filling valve unit
FR1 First direction of flow
FR2 Second direction of flow
M1 First amount
M2 Second amount
M3 Displaced amount

The invention claimed is:

1. A method of filling a container with a filling material having a first liquid component and a second liquid component in a predetermined ratio, said method comprising supplying said first liquid component from a first tank to said container by causing said first liquid component to flow in a first direction through a filling material line, said filling material line being closable by a first filling valve unit, there being a flow rate measuring unit provided to determine an amount of first liquid component fed through said filling material line, feeding said second liquid component into said filling material line, said filling material line having been filled at least in part by said first liquid component, thereby displacing at least a portion of said first liquid component from said filling material line by causing said at least a portion of said first liquid component to flow in a second direction opposite to said first direction, detecting an amount of said second liquid component fed into said filling material line by using said flow rate measuring unit to detect motion of said first liquid component in said second direction in said filling material line, said motion being caused by feeding said second liquid component.

2. The method of claim 1, further comprising closing said first filling valve unit before feeding said second liquid component into said filling material line.

3. The method of claim 1, wherein feeding said second liquid component comprises feeding said second liquid component under pressure from a second tank through a second filling material line having a second filling valve unit connected thereto.

4. The method of claim 3, further comprising selecting said second liquid component to include solid constituents contained therein.

5. The method of claim 3, further comprising selecting said second liquid component to have a viscous consistency.

6. The method of claim 3, further comprising selecting said second liquid component to have a paste-like consistency.

7. The method of claim 1, wherein using a flow rate measuring unit to detect motion comprises detecting an amount by which said first liquid component in said filling material line is displaced in response to feeding said second liquid component.

8. The method of claim 7, further comprising returning at least a portion of a displaced amount of said first liquid component into said first tank.

9. The method of claim 8, wherein returning at least a portion of a displaced amount comprises conducting at least part of said displaced amount to a buffer tank.

10. The method of claim 8, wherein returning at least a portion of a displaced amount comprises conducting at least part of said displaced amount to a return line.

11. The method of claim 1, wherein feeding said second liquid component comprises feeding said component between said flow rate measuring unit and said filling valve unit.

12. The method of claim 1, wherein feeding said second liquid component comprises feeding said second liquid component into a mixing chamber in fluid communication with said filling material line, said mixing chamber being disposed between said flow rate measuring unit and said first filling valve unit.

13. An apparatus for filling a container with a filling material having a first and second liquid component in a predetermined ratio, said apparatus comprising a first tank for holding said first liquid component, a second tank for holding said second liquid component, a first filling valve unit for controlling flow of said first liquid component and said second liquid component into said container, a first filling material line connecting said first filling valve unit to said first tank, said first filling material line defining a first direction, which is toward the first filling valve unit, and a second direction, which is opposite said first direction, a flow rate measuring unit connected between said first liquid tank and said first filling valve unit to determine an amount of only said first liquid component conducted through said filling material line in said first direction, a second filling valve unit that, when opened, cause flow of said first liquid component in said second direction, and a second filling material line connecting said second filling valve unit to said second tank, thereby defining a path, when said second filling valve unit is open, between said second tank and said first filling valve unit, thereby enabling feeding of said second liquid component to said container, wherein said flow rate measuring unit indirectly measures flow of the second liquid by measuring flow of the first liquid in the second direction in response to flow of the second liquid toward the container.

14. The apparatus of claim 13, further comprising a mixing chamber provided between said flow rate measuring unit and said first filling valve unit, said mixing chamber having a fluid connection to said filling material line.

15. The apparatus of claim 13, further comprising a buffer tank provided between said flow rate measuring unit and said first tank, said buffer tank having a fluid connection with said filling material line.

16. The apparatus of claim 13, further comprising a return line disposed to establish a fluid connection between said first tank and a free end of said filling material line facing toward said first filling valve unit.

17. The apparatus of claim 13, further comprising a third filling valve unit downstream of said first tank.

18. The apparatus of claim 13, further comprising a non-return valve downstream of said first tank.

19. The apparatus of claim 13, wherein said flow rate measuring unit comprises a magnetic inductive flow meter.

* * * * *